US010867748B2

(12) United States Patent
Xia et al.

(10) Patent No.: US 10,867,748 B2
(45) Date of Patent: Dec. 15, 2020

(54) METHOD FOR PREPARING A COMPOSITE WIRE AND A POWER INDUCTOR

(71) Applicant: Shenzhen Sunlord Electronics Co., Ltd., Guangdong (CN)

(72) Inventors: Shengcheng Xia, Guangdong (CN); Youyun Li, Guangdong (CN)

(73) Assignee: Shenzhen Sunlord Electronics Co., Ltd., Guangdong (CN)

( * ) Notice: Subject to any disclaimer, the term of this patent is extended or adjusted under 35 U.S.C. 154(b) by 265 days.

(21) Appl. No.: 15/869,054

(22) Filed: Jan. 12, 2018

(65) Prior Publication Data

US 2018/0137950 A1 May 17, 2018

Related U.S. Application Data

(63) Continuation of application No. PCT/CN2016/080727, filed on Apr. 29, 2016.

(51) Int. Cl.
*H01F 41/12* (2006.01)
*H01F 41/02* (2006.01)
(Continued)

(52) U.S. Cl.
CPC ..... *H01F 41/12* (2013.01); *H01B 3/10* (2013.01); *H01B 3/105* (2013.01); *H01B 13/0016* (2013.01); *H01B 13/012* (2013.01); *H01B 13/16* (2013.01); *H01F 41/0246* (2013.01); *H01F 41/061* (2016.01); *H01F 41/125* (2013.01); *H01F 41/127* (2013.01); *H01F 41/32* (2013.01);
(Continued)

(58) Field of Classification Search
CPC ..... H01B 1/02; H01B 1/023; H01B 1/026; H01B 3/10; H01B 3/105; H01B 13/0016; H01B 13/012; H01B 13/16; H01B 7/0216; H01B 7/0291; H01B 7/18; H01B 7/28; H01F 41/0246; H01F 41/061; H01F 41/12; H01F 41/125; H01F 41/127; H01F 41/26; H01F 41/32
See application file for complete search history.

(56) References Cited

U.S. PATENT DOCUMENTS 4,576,694 A * 3/1986 Jidai ..... H01F 41/127 204/488
5,220,133 A * 6/1993 Sutherland ..... H01B 13/0016 156/53
(Continued)

FOREIGN PATENT DOCUMENTS

CN 2689406 3/2005
CN 1822243 8/2006
(Continued)

*Primary Examiner* — A. Dexter Tugbang
(74) *Attorney, Agent, or Firm* — Winston Hsu

(57) ABSTRACT

A method for preparing a power inductor includes the following steps A to E: A: preparing a composite wire; B: winding the composite wire according to a predetermined shape and a predetermined coil quantity, so as to form coils; C: placing the coils into a mold cavity, adding metal soft magnetic powder to the mold cavity, and pressing the metal soft magnetic powder and the coils to form a base comprising the coils; D: performing sintering treatment on the base; and E: plating two terminal electrodes on two ends of the base to form the power inductor.

6 Claims, 2 Drawing Sheets

(51) Int. Cl.

| | |
|---|---|
| ***H01B 13/00*** | (2006.01) |
| ***H01B 13/012*** | (2006.01) |
| ***H01B 3/10*** | (2006.01) |
| ***H01B 13/16*** | (2006.01) |
| ***H01F 41/061*** | (2016.01) |
| ***H01F 41/32*** | (2006.01) |
| *H01F 41/26* | (2006.01) |
| *H01B 7/02* | (2006.01) |
| *H01B 7/18* | (2006.01) |
| *H01B 7/28* | (2006.01) |
| *H01B 1/02* | (2006.01) |

(52) U.S. Cl.
CPC ..... *H01B 1/02* (2013.01); *H01B 1/023* (2013.01); *H01B 1/026* (2013.01); *H01B 7/0216* (2013.01); *H01B 7/0291* (2013.01); *H01B 7/18* (2013.01); *H01B 7/28* (2013.01); *H01F 41/26* (2013.01)

(56) References Cited

U.S. PATENT DOCUMENTS

| | | | | |
|---|---|---|---|---|
| 5,436,409 | A * | 7/1995 | Sawada ..... | H01B 3/105 174/110 A |
| 2014/0110147 | A1* | 4/2014 | Elie ..... | H01B 13/16 174/107 |
| 2015/0155252 | A1* | 6/2015 | Milke ..... | H01B 1/023 428/652 |

FOREIGN PATENT DOCUMENTS

| | | | |
|---|---|---|---|
| CN | 101329928 | | 12/2008 |
| CN | 101728011 | | 6/2010 |
| CN | 101857724 | | 10/2010 |
| CN | 204904960 | | 12/2015 |
| CN | 105934803 | | 9/2016 |
| GB | 809812 | | 3/1959 |
| JP | H02301909 | | 12/1990 |
| JP | 04373112 | A * | 12/1992 |
| WO | 9305520 | | 3/1993 |

* cited by examiner

METHOD FOR PREPARING A COMPOSITE WIRE AND A POWER INDUCTOR

CROSS REFERENCE TO RELATED APPLICATIONS

This application is a continuation application of PCT/CN2016/080727, filed on Apr. 29, 2016. The contents of PCT/CN2016/080727 are all hereby incorporated by reference.

BACKGROUND OF THE INVENTION

1. Field of the Invention

The present invention relates to a composite wire required in a process of manufacturing a magnetic element, a method for preparing same, and a method for preparing the magnetic element, i.e., a power inductor.

2. Description of the Related Art

At present, for a high-temperature-resistant insulated wire, an insulation layer is formed by coating an inorganic oxide, that is, a mesoporous inorganic oxide layer is formed on the surface of a conductor. The high-temperature-resistant insulated wire using such an insulation layer has the following defects: On one hand, if the inorganic oxide layer wraps too densely, the inorganic wrapping layer is likely to fall off during winding due to brittleness of the inorganic oxide layer; on the other hand, if the inorganic oxide layer does not densely wrap, moisture resistance and weather resistance are relatively poor. In addition, manufacturing costs of wrapping the mesoporous inorganic oxide layer on the surface of the conductor are quite high.

SUMMARY OF THE INVENTION

The embodiments of the present application are to provide a high-temperature-resistant, easy-to-wind composite wire having an insulation layer that does not easily fall off and may have good weather resistance in practical use, so as to solve the technical problems that are caused because a mesoporous inorganic oxide layer is used as an insulation layer in an existing high-temperature-resistant insulated wire.

Technical solutions used in the embodiments of the present application to solve the foregoing technical problems areas follows:

A composite wire, comprises a metal inner core, an easily-passivated metal layer wrapping a surface of the metal inner core, and a self-adhesive resin layer wrapping a surface of the easily-passivated metal layer. An insulation layer of the composite wire is a metal passivation layer that is formed by the easily-passivated metal layer after sintering treatment and oxidation. In the composite wire provided in the embodiments of the present application, easily-passivated metal is plated on the surface of the metal inner core. The easily-passivated metal layer is oxidized after the sintering treatment to form the metal passivation layer, which may serve as the insulation layer of the composite wire.

Compared with the prior art, the composite wire may have the following beneficial effects.

1) To ensure desirable insulativity and weather resistance of the insulation layer, the easily-passivated metal layer as a precursor of the insulation layer should be relatively dense. However, even if the easily-passivated metal layer is relatively dense, in practical use of the composite wire, because the easily-passivated metal layer is relatively soft, the composite wire is easily wound and the dense easily-passivated metal layer is unlikely to fall off.

2) The insulation layer of the composite wire is formed by means of sintering treatment when the composite wire is practically used. Before the sintering treatment, in fact, the insulation layer exists as the precursor of the insulation layer (that is, the easily-passivated metal layer). Therefore, when applied to a process of preparing, for example, a magnetic element, the composite wire may be wound according to a predetermined shape and coil quantity first, and then is sintered. In this way, during the sintering of the shaped composite wire, the easily-passivated metal layer of the composite wire is oxidized to form the metal passivation layer (that is, the insulation layer). The density and uniformity of the insulation layer are consistent with those of the original easily-passivated metal layer. The density and uniformity of the original easily-passivated metal layer are quite easy to control when the original easily-passivated metal layer is formed on the surface of the metal inner core. That is, in the composite wire provided in the embodiments of the present application, the easily-passivated metal layer is used as the precursor of the insulation layer, so that the composite wire may be first shaped in practical use, and subsequently, the precursor of the insulation layer becomes a final insulation layer. In this way, a technical contradiction existing in the mesoporous inorganic oxide layer directly wrapping the surface of the metal inner core in the prior art may be solved. The technical contradiction is that "to ensure desirable insulativity and weather resistance, the mesoporous inorganic oxide layer needs to be dense; but once being dense, when wound during use, the mesoporous inorganic oxide layer is likely to fall off due to brittleness, which certainly affects the insulativity and weather resistance".

3) The composite wire may reach weather resistance that bear more than 8 H of standard salt fog and have an insulation voltage resistant capability of more than 100 V as long as it is ensured that the metal passivation layer has a thickness of 100 nm to 500 nm. Corresponding to the metal passivation layer of such a thickness requirement, the easily-passivated metal layer has a moderate thickness and moderate treating costs, and conductive performance of the metal inner core is not affected.

Further, the metal inner core is a nickel-plated copper wire which is formed by plating nickel on a surface of a copper wire by electroplating or electroless plating, and a nickel-plated layer has a thickness of 1/10 to 3/10 of a diameter of the copper wire.

Further, the easily-passivated metal layer is aluminum or chromium, is plated on a surface of the nickel-plated copper wire by electroplating or PVD, and has a thickness of 1/10 to 3/10 of the diameter of the copper wire; and after being sintered at a temperature of 600° C. to 900° C., the easily-passivated metal layer is oxidized on the surface of the nickel-plated copper wire to form the metal passivation layer.

Further, the self-adhesive resin layer is nylon that is formed on the surface of the easily-passivated metal layer by performing coating and drying for multiple times.

The embodiments of the present application are also to provide a method for preparing the foregoing composite wire, comprising the following steps S1 to S3:

S1: providing a metal inner core to serve as a conductor of the composite wire;

S2: plating an easily-passivated metal layer on a surface of the metal inner core and controlling the thickness of the easily-passivated metal layer to be within a predetermined range; and S3: coating a self-adhesive resin layer on a surface of the easily-passivated metal layer.

A metal passivation layer that is formed by the easily-passivated metal layer formed in the step S2 after sintering treatment and oxidation serves as an insulation layer of the composite wire.

Further, the metal inner core is a nickel-plated copper wire which is formed by plating nickel on a surface of a copper wire by electroplating or electroless plating, and a nickel-plated layer has a thickness of 1/10 to 3/10 of a diameter of the copper wire.

Further, the easily-passivated metal layer is aluminum or chromium, is plated on a surface of the nickel-plated copper wire by electroplating or PVD, and has a thickness of 1/10 to 3/10 of the diameter of the copper wire; and after being sintered at a temperature of 600° C. to 900° C., the easily-passivated metal layer forms the metal passivation layer on the surface of the nickel-plated copper wire.

Further, the step S3 specifically comprises: evenly applying a self-adhesive resin paint on the surface of the easily-passivated metal layer by felt dip-coating, with a thickness of 1 μm to 2 μm for each application, and repeating the application and drying operations at a temperature of 80° C. to 150° C. multiple times to form the self-adhesive resin layer.

The embodiments of the present application are also to provide a method for preparing a power inductor, comprising the following steps A to E:

A: preparing the composite wire according to the above method for preparing the composite wire;

B: winding the composite wire prepared in the step A, according to a predetermined shape and a predetermined coil quantity, so as to form coils;

C: placing the coils into a mold cavity, adding metal soft magnetic powder to the mold cavity, and pressing the metal soft magnetic powder and the coils to form a base comprising the coils;

D: performing sintering treatment to the base at a temperature of 600° C. to 900° C., where during the sintering treatment, an outermost self-adhesive resin layer on the composite wire is carbonized and oxidized to form a gas to be discharged, and at the same time, the easily-passivated metal layer is oxidized to form the metal passivation layer; and E: plating two terminal electrodes on two ends of the base processed in the step D, where the two terminal electrodes are respectively connected to two end portions of the coils, so as to form the power inductor.

The method for preparing a power inductor provided above may have the following advantages: It is known that an electrical property (such as a magnetic permeability or a saturation magnetic flux) of a conventional integrally formed inductor is mainly determined by a magnetic material (equivalent to the foregoing metal soft magnetic powder). For a same magnetic material, the magnetic permeability and the saturation magnetic flux of the inductor are in direct proportion to the density of the magnetic material. To improve the electrical property, the density of the magnetic material needs to be improved. A method for improving the density of the magnetic material is to increase a pressure during squeezing molding. A coil of the conventional integrally formed inductor is a polyurethane enameled wire. If a squeezing force is excessively large during squeezing, a paint film is very likely to break and fall off, causing a reduction of voltage resistance between coil layers or even causing a short circuit. However, the embodiments of the present application are based on "the easily-passivated metal layer is soft and unlikely to fall off, and can form a metal passivation layer that may have high weather resistance and voltage resistance after being sintered at a high temperature of 600° C. to 900° C.". A process of pressing first and sintering later is used. During pressing, a large squeezing force may be used without causing breaking and falling off of the easily-passivated metal layer, ensuring that a final prepared power inductor may obtain a relatively good electrical property, and desirable insulation and high voltage resistance are obtained between the coil layers based on the metal passivation layer after the easily-passivated metal layer is sintered. In this way, a technical contradiction between the electrical property and voltage resistance existing in the conventional integrally formed inductor may be resolved.

When the composite wire is prepared according to the above method, the metal inner core used in the step A is a silver wire, an aluminum wire, or a nickel-plated copper wire, the easily-passivated metal layer is aluminum or chromium, and after the sintering treatment is performed on the easily-passivated metal layer in the step D, an aluminum oxide layer or a chromic oxide layer is correspondingly generated to wrap the surface of the metal inner core.

These and other objectives of the present invention will no doubt become obvious to those of ordinary skill in the art after reading the following detailed description of the preferred embodiment that is illustrated in the various figures and drawings.

DETAILED DESCRIPTION

The following further describes the present application with reference to the accompanying drawings and preferred implementations.

An embodiment of the present application provides a composite wire comprising an easily-passivated metal layer. The composite wire comprises a metal inner core, an easily-passivated metal layer wrapping a surface of the metal inner core, and a self-adhesive resin layer wrapping a surface of the easily-passivated metal layer. An insulation layer of the composite wire is a metal passivation layer that is formed by the easily-passivated metal layer after sintering treatment and oxidation.

The metal inner core of the composite wire may be, for example, a silver wire, an aluminum wire, or a nickel-plated copper wire, and the nickel-plated copper wire is preferably used because the nickel-plated copper wire has better high-temperature resistance and conductive performance is less affected by a high temperature. When the nickel-plated copper wire is used as the metal inner core in the composite wire, for an internal structure of the composite wire, reference may be made to FIG. 1. It is sequentially a copper wire 10, a nickel layer 20, an easily-passivated metal layer 30, and a self-adhesive resin layer 40 from the inside to the outside of the structure. The nickel-plated copper wire is formed by plating the nickel layer 20 on a surface of the copper wire 10 by electroplating or electroless plating, and the plated nickel layer 20 preferably has a thickness of 1/10 to 3/10 of a diameter of the copper wire 10.

Figure 1:
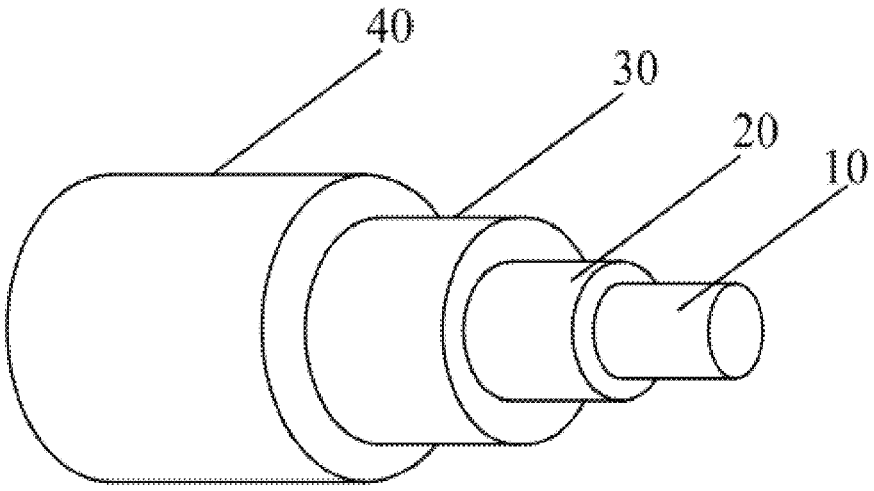
FIG. 1 is a schematic structural diagram of a composite wire comprising an easily-passivated metal layer according to the present application.

In a preferred embodiment, a material of the easily-passivated metal layer 30 is aluminum or chromium, and the easily-passivated metal layer is plated on the surface of the metal inner core by electroplating or PVD. Referring to FIG. 1, when the metal inner core is the nickel-plated copper wire, the easily-passivated metal layer 30 is formed on a surface of the nickel layer 20, and has a thickness of 1/10 to 3/10 of the diameter of the copper wire 10. After being sintered at a temperature of 600° C. to 900° C., the easily-passivated metal layer 30 could be oxidized on the surface of the metal inner core, for example, the nickel-plated copper wire, to form a metal passivation layer. The metal passivation layer is an oxide of easily-passivated metal, for example, an aluminum oxide or a chromic oxide. When the easily-passivated metal is chromium, a main component of the metal passivation layer is $Cr_2O_3$. The metal passivation layer formed after the sintering treatment by the easily-passivated metal layer 30 is the insulation layer of the composite wire.

Another embodiment of the present application provides a method for preparing the foregoing composite wire. The method comprises the following steps S1 to S3:

S1: Provide a metal inner core to serve as a conductor of the composite wire. As described above, the metal inner core may mainly be a silver wire, an aluminum wire, or a nickel-plated copper wire that has a more stable resistance at a high temperature, and may alternatively be another common conductor.

S2: Plate an easily-passivated metal layer on a surface of the metal inner core and control the thickness of the easily-passivated metal layer to be within a predetermined range. For example, when the metal inner core is a nickel-plated copper wire, the easily-passivated metal layer has a thickness of 1/10 to 3/10 of a diameter of the copper wire.

S3: Coat a self-adhesive resin layer on a surface of the easily-passivated metal layer. The self-adhesive resin layer may be, for example, nylon, and is formed on the surface of the easily-passivated metal layer by performing coating and drying for multiple times. For example, a specific operation comprises: evenly applying a self-adhesive resin paint on the surface of the easily-passivated metal layer by felt dip-coating, with a thickness 1 μm to 2 μm for each application, and repeating the application and drying operations at a temperature of 80° C. to 150° C. multiple times to form the self-adhesive resin layer.

Figure 2:
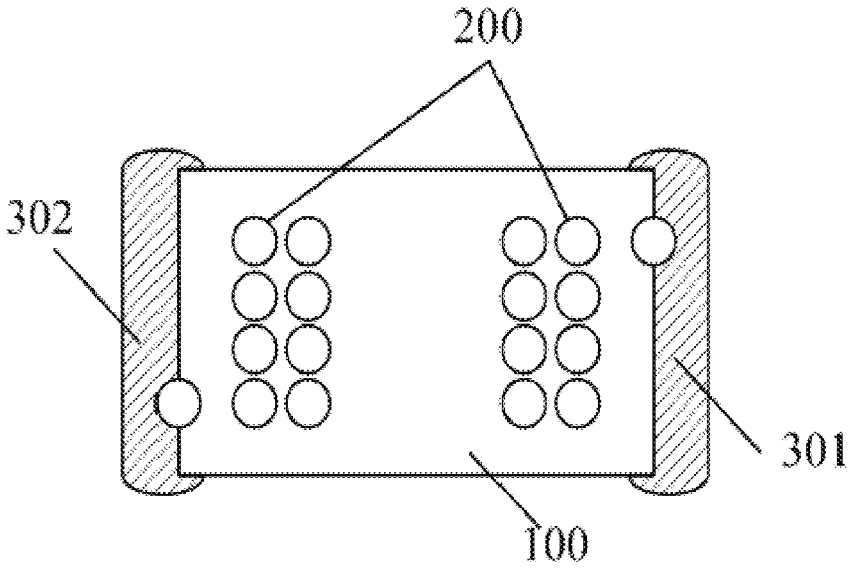
FIG. 2 is a schematic structural diagram of a power inductor using the composite wire in the present application.

A specific embodiment of the present application provides a new type of power inductor. In the power inductor, the foregoing composite wire is used as coils. As shown in FIG. 2, the power inductor comprises: a base 100, coils 200 inside the base, and terminal electrodes 301 and 302 respectively connected to two ends of the coils. A method for preparing the power inductor is specifically as follows:

Step A: Preparing the composite wire according to the method for preparing the composite wire disclosed in the foregoing embodiment;

Step B: winding the composite wire prepared in the step A to form the coils of the power inductor, according to a predetermined shape and a predetermined coil quantity;

Step C: placing the coils into a mold cavity, adding metal soft magnetic powder to the mold cavity, and pressing the metal soft magnetic powder and the coils to form a base comprising the coils;

Step D: performing sintering treatment on the base at a temperature of 600° C. to 900° C., where during the sintering treatment, an outermost self-adhesive resin layer on the composite wire is carbonized and oxidized to form a gas to be discharged, and at the same time, the easily-passivated metal layer is oxidized to form the metal passivation layer; and Step E: plating two terminal electrodes on two ends of the base processed in step D, where the two terminal electrodes are respectively connected to two end portions of the coils, so as to form the power inductor.

After step D is completed, if a coil protrudes from an outer surface of two ends of the base, grinding and polishing are performed, and terminal electrodes are plated subsequently.

The foregoing content is merely detailed descriptions made on the present application by using specific preferred embodiments, and it should not be understood that specific embodiments of the present application are limited to these descriptions. A person skilled in the art may further make several equivalent replacements or obvious variations without departing from the idea of the present application to achieve the same performance or purposes, and such replacements and variations shall fall within the protection scope of the present application.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for preparing a power inductor, comprising the following steps A to E:

A: preparing a composite wire, wherein the composite wire comprises a metal inner core, an easily-passivated metal layer wrapping a surface of the metal inner core, and a self-adhesive resin layer wrapping a surface of the easily-passivated metal layer, comprising the following steps S1 to S3:

S1, providing the metal inner core to serve as a conductor of the composite wire;

S2, plating an easily-passivated metal layer on the surface of the metal inner core and controlling a thickness of the easily-passivated metal layer to be within a predetermined range;

S3, coating the self-adhesive resin layer on a surface of the easily-passivated metal layer;

B: winding the composite wire prepared in the step A, according to a predetermined shape and a predetermined coil quantity, so as to form coils;

C: placing the coils into a mold cavity, adding metal soft magnetic powder to the mold cavity, and pressing the metal soft magnetic powder and the coils to form a base comprising the coils;

D: performing sintering treatment on the base at a temperature of 600° C. to 900° C., wherein during the sintering treatment, the self-adhesive resin layer is carbonized and oxidized to form a gas to be discharged, and at the same time, the easily-passivated metal layer is oxidized to form the metal passivation layer to serve as an insulation layer; and E: plating two terminal electrodes on two ends of the base processed in the step D, wherein the two terminal electrodes are respectively connected to two end portions of the coils, so as to form the power inductor.

2. The method for preparing a power inductor according to claim 1, wherein when the composite wire is prepared in the step A, the metal inner core used is a silver wire, an aluminum wire, or a nickel-plated copper wire.

3. The method for preparing a power inductor according to claim 2, wherein the metal inner core is a nickel-plated copper wire which is formed by plating nickel on a surface of a copper wire by electroplating or electroless plating, and a nickel-plated layer has a thickness of 1/10 to 3/10 of a diameter of the copper wire.

4. The method for preparing a power inductor according to claim 3, wherein the easily-passivated metal layer is aluminum or chromium, is plated on a surface of the nickel-plated copper wire by electroplating or PVD, and has a thickness of 1/10 to 3/10 of the diameter of the copper wire; and after the sintering treatment is performed on the easily-passivated metal layer in the step D, the easily-passivated metal layer forms the metal passivation layer on the surface of the nickel-plated copper wire.

5. The method for preparing a power inductor according to claim 1, wherein the easily-passivated metal layer is aluminum or chromium, and after the sintering treatment is performed on the easily-passivated metal layer in the step D, an aluminum oxide layer or a chromic oxide layer is correspondingly generated to wrap the surface of the metal inner core.

6. The method for preparing a power inductor according to claim 1, wherein the step S3 specifically further comprises: evenly applying a self-adhesive resin paint on the surface of the easily-passivated metal layer by felt dip-coating, with a thickness of 1 μm to 2 μm for each application, and repeating the application and drying operations at a temperature of 80° C. to 150° C. multiple times, so as to form the self-adhesive resin layer.

* * * * *